US005827302A

United States Patent [19]

Kandarian et al.

[11] Patent Number: 5,827,302

[45] Date of Patent: Oct. 27, 1998

[54] FEMININE GENITAL AREA DEPILATORY AID

[76] Inventors: Ronald B. Kandarian, 575 Sunset Blvd. Suite 106, Kalispell, Mont. 59901; Susan M. Cohenour, P.O. Box 235, Kalispell, Mont. 59903

[21] Appl. No.: 798,559

[22] Filed: Feb. 11, 1997

[51] Int. Cl.[6] ..... A61B 17/04

[52] U.S. Cl. ..... 606/157; 606/151

[58] Field of Search ..... 606/151, 157

[56] References Cited

U.S. PATENT DOCUMENTS

| | | | |
|---|---|---|---|
| 2,491,050 | 12/1949 | McAdoo | 606/151 |
| 3,091,828 | 6/1963 | Soltis | 606/151 |
| 3,598,125 | 8/1971 | Cogley | 606/157 |
| 5,064,429 | 11/1991 | Waterman et al. | 606/151 |
| 5,142,776 | 9/1992 | Neely | 606/151 |

*Primary Examiner*—Gary Jackson
*Attorney, Agent, or Firm*—Keith S. Bergman

[57] ABSTRACT

A depilatory aid for use on female external genitalia provides a pair of similar clamping arms pivotally interconnected at first edges, biased to a clamping position, and having opposed lever arms extend from the first edges for opening. The clamping arms are convexly shaped to define an internal space and have second edges for engagement about the genitalia for protection during depilatory process. Portions of space between the peripheries of the clamping arms are covered.

4 Claims, 3 Drawing Sheets

FEMININE GENITAL AREA DEPILATORY AID

BACKGROUND—FIELD OF INVENTION

This invention is a depilatory aid used to protect the female external genitalia from irritation and injury when removing unwanted hair in the genital area of the female.

BACKGROUND DISCUSSION OF PRIOR ART

Depilatory preparations in the form of creams or liquids are sold to consumers. When using such a preparation to remove unwanted hair in the genital area, exposure of the female external genitalia to the preparation may occur. This exposure causes irritation and injury to the female genitalia. Further, when a depilatory instrument such as a razor is used to remove unwanted hair in the genital area, potential for irritation and injury exists.

It is not known to the Inventors that this problem has been approached by any prior art.

Our invention solves the problem of irritation and injury to the female genitalia when applying depilatory agents or using a depilatory device to remove unwanted hair near the female genitalia. It gathers and shields the vulva. In this manner irritation and injury to the female genitalia is prevented. Further, the gathering of the vulva makes accessing the areas of unwanted hair near the genitalia more practical.

OBJECTS AND ADVANTAGES

It is an object of our invention to protect the sensitive female genitalia from irritation and injury when removing unwanted hair near the female genital area. Irritation and injury can result by exposing the genitalia to depilatory preparations in the form of a cream or a liquid. Also depilatory instruments such as a razor can cause irritation and injury. Another object of our invention is to gather the vulva to aid in accessing the area of unwanted hair. This allows easy application of the depilatory agents or use of a depilatory instrument near the female genitalia.

Further objects and advantages of our invention will become apparent from a consideration of the drawings and ensuing description of it.

DESCRIPTION OF DRAWINGS

FIG. 1 is an isometric view.

FIG. 2 is a side view.

FIG. 3 is a cross-sectional view indicated by section lines 3—3 in FIG. 2.

FIG. 4 is a top view.

FIG. 5 is a front view.

FIG. 6 is a back view.

FIG. 7 is a bottom view.

List of Reference Numerals

Figure 1:
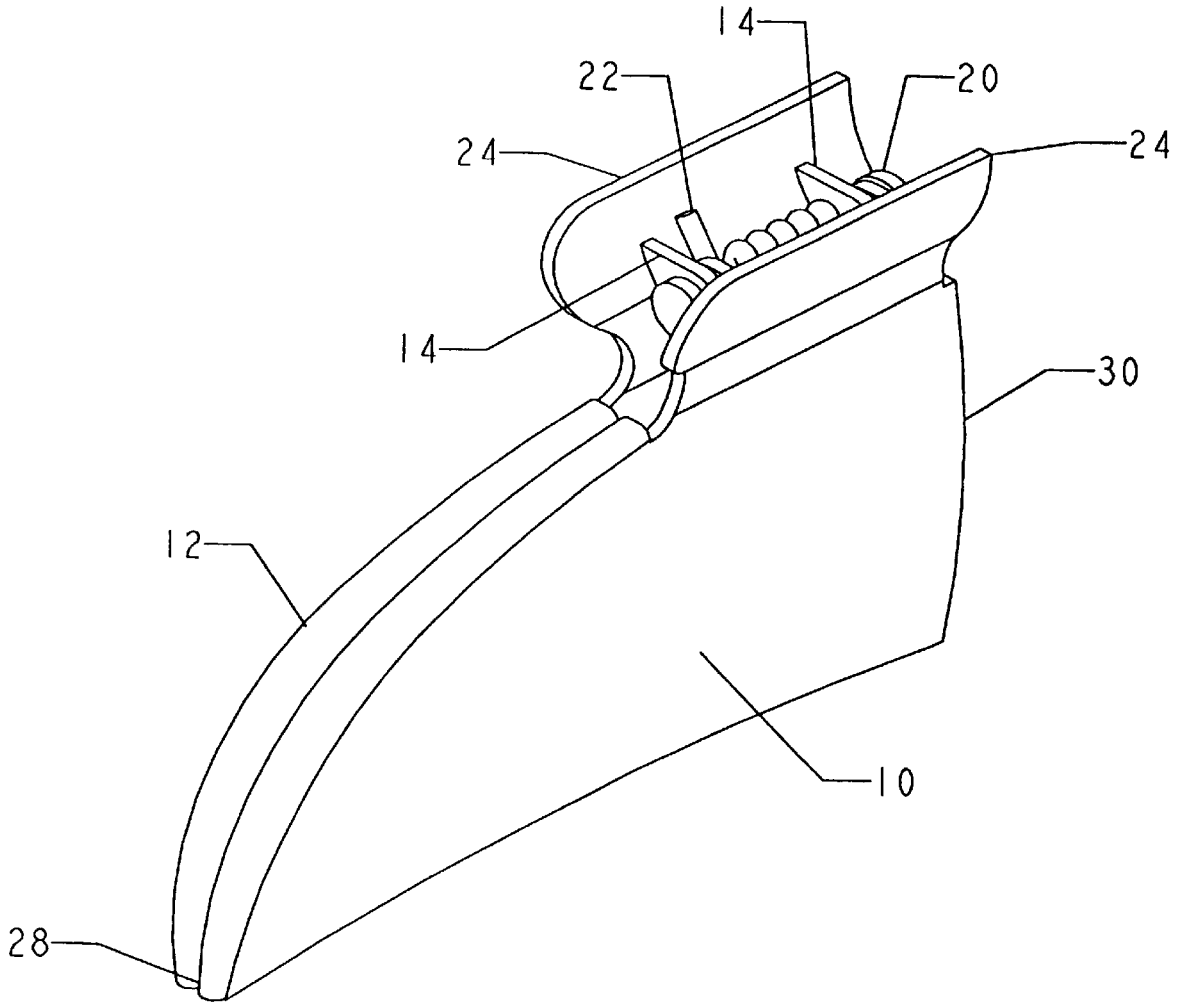
FIGS. 1 through 7 show various aspects of the instant feminine genital depilatory aid.

| | | | |
|---|---|---|---|
| 10 | side | 12 | edges |
| 14 | flange | 16 | hinge point |
| 18 | cavity | 20 | retaining pin |
| 22 | spring | 24 | lever |

-continued

List of Reference Numerals

| | | | |
|---|---|---|---|
| 26 | slit | 28 | contact point |
| 30 | cover lip | | |

1. DESCRIPTION OF INVENTION

Figure 2:
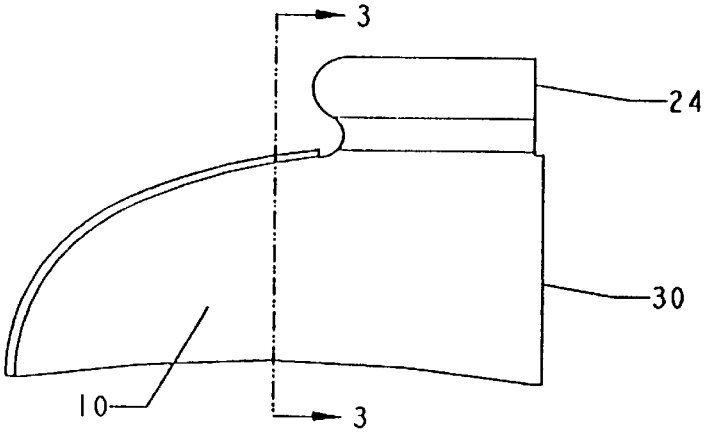
Figure 3:
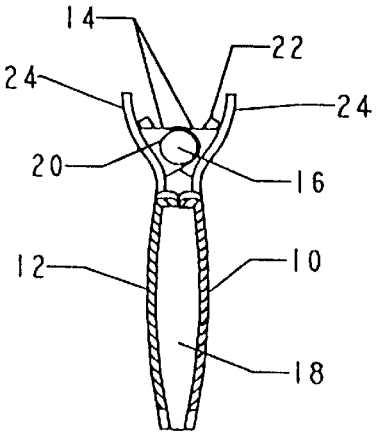
Figure 4:
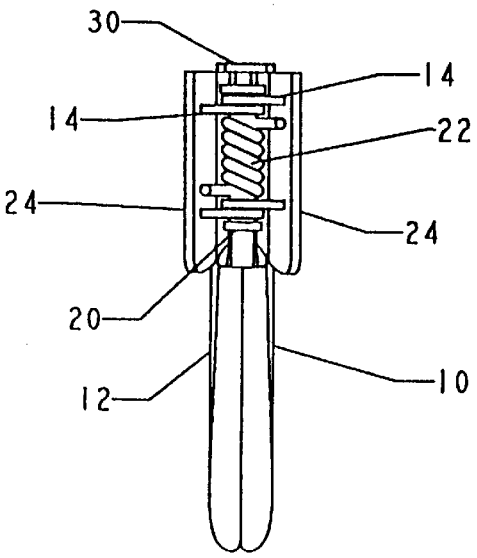
Figure 5:
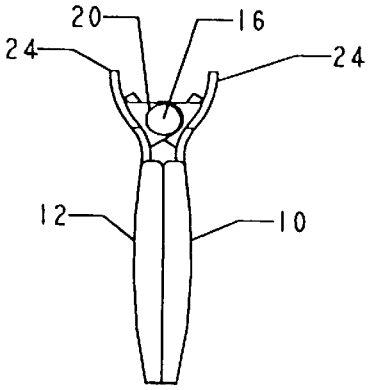
Figure 6:
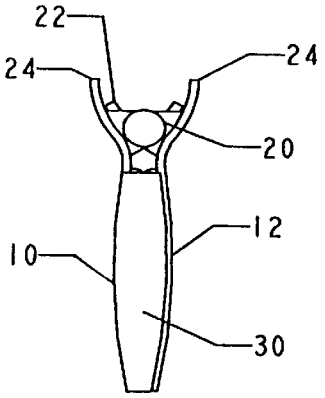
Figure 7:
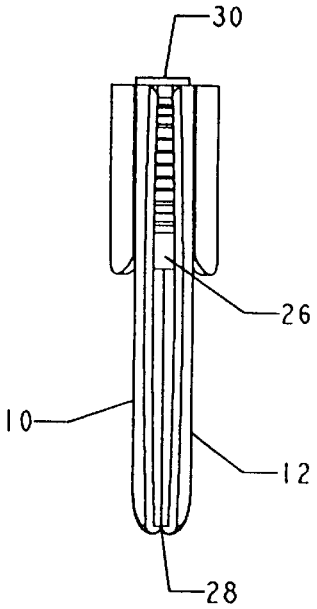
Figure 8:
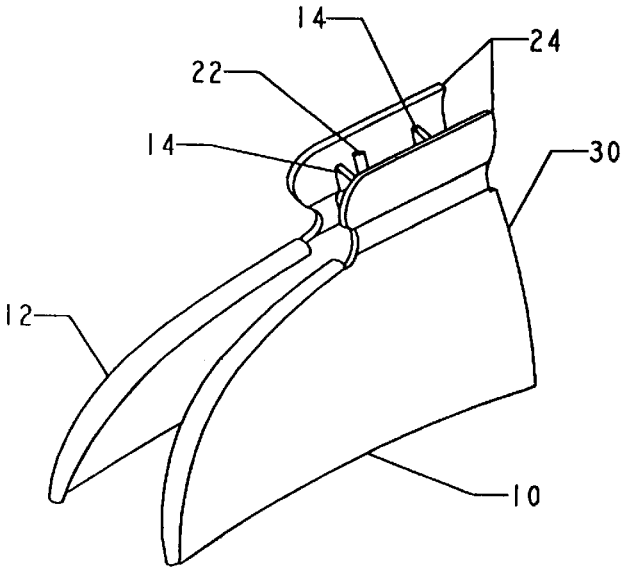
FIG. 8 is an isometric view depicting relative motion motion of the parts.

A typical embodiment of the present invention is illustrated in FIG. 1 (isometric view). It is composed of substantially trapezoidal clamping arms having sides 10 and 10'. Each side having a second a second edge 15 at a base portion 8 and a first arcuate edge 12 at top portion 7. The first edge 12 and second edge 15 are connected at a point 28. Each side is formed of a uniform nominal wall thickness from a thermoplastic such as high density polyethylene. Additionally, each side has two flanges 14 extending in plane tangent to a curve created at the inside surface of each side 10 and 10'. The flanges 14 have similar clearance holes defined therein in with centers lineally aligned. FIG. 2 is a side view with section lines indicating the cross-section of FIG. 3. The cross-section of FIG. 3 illustrates the cavity 18. The hinge point 16 is located on a bilateral plane between side 10 and side 10'. The clearance holes in flanges 14 are located such that when the two sides 10 and 10' are positioned on the bilateral plane, and the holes in side 10 are aligned with the holes in side 10' the two sides create cavity 18. Retaining pin 20 is positioned through the clearance holes in the four flanges 14. Between the flanges 14 mounted on the retaining pin 20 is spring 22. Spring 22 is positioned such that its flexural members place a separating force on levers 24. Levers 24 extend upward and away from the hinge point 16 symmetrically about the bilateral plane. FIG. 7 (bottom view) depicts slit 26 and contact point 28 between sides 10 and 10' when the device is assembled with spring 22 and is not under any external forces. FIG. 5 (front view) illustrates the closed front portion where sides 10 and 10' create a vertical line of contact above contact point 28. FIG. 6 (back view) illustrates the cover lip 30 which is part of side 10 and encloses cavity 18. FIG. 8 is an isometric view depicting pivot action about hinge point 16 when levers 24 are subjected to external forces normal to and toward the bilateral plane.

OPERATION OF INVENTION

Operation of the invention is accomplished by grasping the levers 24 between a thumb and forefinger of a single hand. Then apply a squeezing force using the thumb and forefinger to deflect spring 22 which is retained between levers 24 by retaining pin 20. Retaining pin 20 is retained in clearance holes in flanges 14. The squeezing action forces levers 24 to pivot about hinge point 16 and align themselves close to one another. The same action causes sides 10 and 10' to pivot about hinge point 16 and create a large opening in place of slit 26. Maintaining the squeezing force using the thumb and forefinger, the device is placed over extended tissues of the female genitalia. Relaxing the squeezing force generated by the thumb and forefinger allows spring 22 to return sides 10 and 10' to the closed position. This places the device around the female external genitalia such that they are retained in cavity 18 and shielded by sides 10 and 10' and cover lip 30. Contact point 28 is once again a contact point between sides 10'. The device retains itself in this position while depilatory practices are executed. After depilation is completed the device is grasped about levers 24 again by the thumb and forefinger of a single hand. A squeezing force is applied to levers 24 which separates sides 10 and 10' which opens the cavity 18 and allows the device to be pulled away from the genitalia.

CONCLUSION, RAMIFICATIONS, AND SCOPE OF INVENTION

Thus the reader will see that our invention fulfills the desired objectives of protecting the female external genitalia from irritation and injury by shielding them from depilatory preparations and devices. Further, it facilitates depilation by gathering the vulva and exposing the areas of unwanted hair. The invention is simple to manufacture and it is easily implemented for its intended purposes.

While our above description contains many specifics, these should not be construed as limitations on the scope of the invention, but rather as an exemplification of one preferred embodiment thereof. Many other variations are possible.

We claim:

1. A depilatory aid for female external genitalia, comprising in combination:

a pair of clamping arms having opposed sides a first edge with an arcuate portion and second edge, said clamping arms being pivoted at the first edges for motion about a common bilateral plane and adapted at the second edges for clamping engagement with external female genitalia;

spring means biasing the clamping arms to a clamping position;

the second edges of each clamping arm being curved transversely to provide concave second edges and said opposed sides being curved convexly outwardly from the common medial plane intermediate their first and second edges to provide a space between the sides, the second edges of the sides being spacedly adjacent when the clamping arms are closed to provide engagement on female genitalia; and operating levers extending from the first edges of each clamping arm with the spring means engaging each operating lever.

2. The depilatory aid of claim 1 wherein the first and second edges of each clamping arm intersect and a third edge extendings between the first and second edges spacedly distant from their intersection to form curvilinear clamping arms of triangle-like peripheral configuration.

3. The depilatory aid of claim 2 wherein a third edge and at least a portion of the first edge adjacent the intersection with the second edge have inwardly extending flange-like portion.

4. The depilatory aid of claim 1 wherein the spring means comprises a torsion spring coaxial with the pivotal axis of the clamping arms and having two opposed torsion arms each contacting a different operating lever.

* * * * *